US010830221B2

(12) United States Patent
Achten

(10) Patent No.: US 10,830,221 B2
(45) Date of Patent: Nov. 10, 2020

(54) HYDRAULIC DEVICE, A METHOD OF MANUFACTURING A HYDRAULIC DEVICE AND A GROUP OF HYDRAULIC DEVICES

(71) Applicant: INNAS BV, Breda (NL)

(72) Inventor: Peter Augustinus Johannes Achten, Eindhoven (NL)

(73) Assignee: INNAS BV, Breda (NL)

( * ) Notice: Subject to any disclaimer, the term of this patent is extended or adjusted under 35 U.S.C. 154(b) by 108 days.

(21) Appl. No.: 16/099,366

(22) PCT Filed: May 17, 2017

(86) PCT No.: PCT/EP2017/061852
§ 371 (c)(1),
(2) Date: Nov. 6, 2018

(87) PCT Pub. No.: WO2017/198719
PCT Pub. Date: Nov. 23, 2017

(65) Prior Publication Data

US 2019/0211812 A1 Jul. 11, 2019

(30) Foreign Application Priority Data

May 19, 2016 (EP) ..... 16170439

(51) Int. Cl.
*F04B 1/24* (2006.01)
*F04B 1/22* (2006.01)
(Continued)

(52) U.S. Cl.
CPC ..... *F04B 1/22* (2013.01); *F03C 1/0639* (2013.01); *F03C 1/0671* (2013.01); *F04B 1/2085* (2013.01)

(58) Field of Classification Search
CPC ..... F01B 3/0055; F04B 1/2042; F04B 1/205; F04B 1/2057
See application file for complete search history.

(56) References Cited

U.S. PATENT DOCUMENTS 3,057,668 A * 10/1962 Cornelius ..... F01B 3/0032 92/257
3,162,142 A * 12/1964 Wiggermann ..... F04B 1/22 91/500
(Continued)

FOREIGN PATENT DOCUMENTS

CN 101313148 A 11/2008
CN 101523052 A 9/2009
(Continued)

OTHER PUBLICATIONS

International Search Report, dated Jun. 23, 2017 for corresponding International Patent Application No. PCT/EP2017/061852, filed May 17, 2017.
(Continued)

*Primary Examiner* — Michael Leslie
*Assistant Examiner* — Matthew Wiblin
(74) *Attorney, Agent, or Firm* — Steven M. Koehler; Westman, Champlin & Koehler, P.A.

(57) ABSTRACT

A hydraulic device comprises a housing, a shaft rotatable about a first axis of rotation and a flange. A plurality of cylindrical sleeves cooperate with a plurality of pistons on the flange to form compression chambers, wherein the cylindrical sleeves are rotatable about a second axis of rotation which intersects the first axis of rotation by an acute angle such that upon rotating the shaft the volumes of the compression chambers change. A barrel plate is rotatable about the second axis has a first side for supporting the cylindrical sleeves. An opposite second side is supported by a supporting surface of a plate-shaped face element which is fixed to the housing. The supporting surface lies in a first plane. The face element has a back side that lies in a second plane, which forms an angle with the first plane that is smaller than said acute angle.

20 Claims, 3 Drawing Sheets

(51) Int. Cl.
*F04B 1/2085* (2020.01)
*F03C 1/06* (2006.01)

(56) References Cited

U.S. PATENT DOCUMENTS

| | | | | | |
|---|---|---|---|---|---|
| 3,434,429 | A * | 3/1969 | Goodwin | F01B 3/0038 | 91/490 |
| 3,630,026 | A * | 12/1971 | Ifield | F01B 3/0035 | 60/492 |
| 3,648,567 | A | 3/1972 | Clark | | |
| 3,948,111 | A | 4/1976 | Dittrich | | |
| 3,958,456 | A | 5/1976 | Jacobson | | |
| 4,223,594 | A | 9/1980 | Gherner | | |
| 4,361,077 | A | 11/1982 | Mills | | |
| 4,703,682 | A | 11/1987 | Hansen | | |
| 4,776,257 | A | 10/1988 | Hansen | | |
| 5,249,506 | A * | 10/1993 | Willimczik | F01B 3/0032 | 417/462 |
| 5,304,043 | A * | 4/1994 | Shilling | F04B 27/0804 | 417/269 |
| 5,415,530 | A | 5/1995 | Shilling | | |
| 5,636,561 | A | 6/1997 | Pecorari | | |
| 5,778,757 | A | 7/1998 | Kristensen et al. | | |
| 5,794,514 | A | 8/1998 | Pecorari | | |
| 5,960,697 | A | 10/1999 | Hayase et al. | | |
| 6,152,014 | A * | 11/2000 | Willimczik | F01B 3/0038 | 417/269 |
| 6,283,721 | B1 | 9/2001 | Gollner | | |
| 6,293,768 | B1 | 9/2001 | Shintoku et al. | | |
| 6,312,231 | B1 | 11/2001 | Kuhne et al. | | |
| 6,629,822 | B2 | 10/2003 | Larkin et al. | | |
| 6,663,354 | B2 | 12/2003 | Forster | | |
| 7,311,034 | B2 | 12/2007 | Achten | | |
| 7,328,647 | B2 | 2/2008 | Achten | | |
| 7,470,116 | B2 * | 12/2008 | Dantlgraber | F01B 3/0035 | 417/269 |
| 7,731,485 | B2 | 6/2010 | Achten | | |
| 8,794,938 | B2 | 8/2014 | Frey | | |
| 2005/0017573 | A1 | 1/2005 | Achten | | |
| 2005/0019171 | A1 | 1/2005 | Achten | | |
| 2005/0201879 | A1 | 9/2005 | Achten | | |
| 2006/0051223 | A1 | 3/2006 | Mark et al. | | |
| 2006/0120881 | A1 | 6/2006 | Dantlgraber | | |
| 2006/0222516 | A1 | 10/2006 | Achten | | |
| 2007/0251378 | A1 | 11/2007 | Nelson | | |
| 2009/0007773 | A1 | 1/2009 | Zhu | | |
| 2009/0084258 | A1 | 4/2009 | Stoelzer | | |
| 2009/0196768 | A1 | 8/2009 | Nelson et al. | | |
| 2009/0290996 | A1 | 11/2009 | Ishizaki | | |
| 2010/0119394 | A1 | 5/2010 | Frey | | |

FOREIGN PATENT DOCUMENTS

| | | | |
|---|---|---|---|
| DE | 2130514 | A1 | 12/1972 |
| DE | 3519783 | A1 | 12/1986 |
| DE | 102006021570 | A1 | 10/2007 |
| DE | 102008012404 | A1 | 9/2009 |
| EP | 1508694 | A1 | 2/2005 |
| EP | 1855002 | A1 | 11/2007 |
| EP | 2012010 | A1 | 1/2009 |
| GB | 2446348 | A | 8/2008 |
| JP | 2005514552 | A | 5/2005 |
| JP | 2005522631 | A | 7/2005 |
| JP | 2009531590 | A | 9/2009 |
| NL | 1019736 | C1 | 7/2003 |
| NL | 1020932 | C2 | 7/2003 |
| WO | 8600662 | A1 | 1/1986 |
| WO | 2003058035 | A1 | 7/2003 |
| WO | 2004055369 | A1 | 7/2004 |
| WO | 2006083163 | A1 | 8/2006 |
| WO | 2007060822 | A1 | 5/2009 |

OTHER PUBLICATIONS

Written Opinion of the International Searching Authority, dated Jun. 23, 2017 for corresponding International Patent Application No. PCT/EP2017/061852, filed May 17, 2017.
"Volumetric losses of a multi piston floating cup pump", Peter A.J. Achten; Proceedings of the National Conference on Fluid Power; 337-348; Proceedings of the 50th National conference on fluid power by National Fluid Power Association; 2005, NCFP 105-10.2.
U.S. Appl. No. 16/099,356, filed Nov. 6, 2018.
U.S. Appl. No. 16/099,369, filed Nov. 6, 2018.

* cited by examiner

HYDRAULIC DEVICE, A METHOD OF MANUFACTURING A HYDRAULIC DEVICE AND A GROUP OF HYDRAULIC DEVICES

CROSS-REFERENCE TO RELATED APPLICATION

The present application is a national stage of and claims priority of International patent application Serial No. PCT/EP2017/061852, filed May 17, 2017, and published in English as WO/2017/198719.

BACKGROUND

The present invention relates to a hydraulic device, in particular, a hydraulic device having a shaft which is mounted in a housing and rotatable about a first axis of rotation. The shaft has a flange extending transversely to the first axis. A plurality of pistons is fixed to the flange at equiangular distance about the first axis of rotation. A plurality of cylindrical sleeves cooperates with the pistons to form respective compression chambers of variable volume. The cylindrical sleeves are rotatable about a second axis of rotation which intersects the first axis of rotation by an acute angle such that upon rotating the shaft the volumes of the compression chambers change. A barrel plate is rotatable about the second axis and has a first side that is directed to the pistons and supports the cylindrical sleeves. An opposite second side of the barrel plate is supported by a supporting surface of a plate-shaped face element which is fixed to the housing. The supporting surface lies in a first plane and the face element has a back side, which is located opposite to the supporting surface and supported by the housing, lies in a second plane. The first plane is angled with respect to the second plane.

In such a hydraulic device, the shaft has a flange which extends perpendicularly to the first axis and the pistons are fixed to the flange at equiangular distance about the first axis of rotation. An equal number of cylindrical sleeves are supported by a barrel plate and rotate together with the barrel plate about the second axis of rotation, which is angled with respect to the first axis of rotation. The supporting surface of the face element dictates the acute angle between the second axis and the first axis. During rotation of the barrel plate the cylindrical sleeve makes a combined translating and swiveling motion around the piston. In practice varying displacements or capacities of the hydraulic device are desired, depending on the field of application of the hydraulic device.

SUMMARY

An aspect of the invention is to provide a hydraulic device which allows the manufacture of a group of similar hydraulic devices with varying displacements but a minimal number of different parts in an efficient manner. In an embodiment, a hydraulic device of the type described above has an angle between the first plane and the second plane that is smaller than the acute angle.

Since the angle between the first plane and the second plane is smaller than the mentioned acute angle, the largest part of the acute angle can be created by the orientation of a supporting wall of the housing which supports the back side of the face element. The supporting wall of the housing extends non-perpendicularly with respect to the first axis of rotation. For example, the angle between the supporting wall of the housing and the first axis of rotation is 97°, whereas the angle between the first plane and the second plane is 1°.

When applying face elements which have different angles between the respective first and second plane in two identical housings of hydraulic devices, the devices have different displacements.

This design advantageously provides the opportunity to use different face elements which are relatively compact with respect to the prior art face plate as mentioned hereinbefore, since the largest part of the mentioned acute angle is created by the orientation of the supporting wall of the housing. Particularly, in case of starting with a uniform intermediate face plate including parallel front and back surfaces, it is relatively simple to modify two such identical uniform intermediate face plates into two face elements having different angles between their first and second planes, for example an angle of +1° and −1°. This provides the opportunity of manufacturing hydraulic devices having different capacities, which devices comprise similar components, but different face element dimensions. This is relevant in terms of stock control in series production.

In practice, the angle between the first plane and the second plane is smaller than 1.5°, preferably smaller than 1.2°. The acute angle will be larger than 5°, for example 7°.

In a specific embodiment the housing and the face element are configured such that the face element can be mounted in the housing at at least two different mutual positions in which said acute angle is different. Consequently, the displacement of the hydraulic device can be changed by selecting one of the at least two mutual positions upon assembly of a device. In this case, uniform face plates can be kept in stock and depending on the desired displacement of the hydraulic device the corresponding position of the face element in the housing can be selected.

The face element may be mountable in the housing at different rotational positions about an axis having a component in the same direction as the first axis of rotation. In this case the back side of the plate-shaped face element rests against the supporting wall of the housing. Since the planes in which the supporting surface and the back side of the face element lie are angled with respect to each other, the inclination of the supporting surface with respect to the first axis of rotation is different at two different rotational positions of the face element about an axis which has a component in the same direction as the first axis of rotation. Consequently, the acute angle is different. An advantage of this embodiment is that all components of two devices may be identical, but the orientations of the respective supporting surfaces are different, resulting in different displacements. Although both devices have face elements of identical angles between their first and second planes, they may have differently dimensioned kidney-shaped ports, which ports are normally present in a face plate for passing fluid between the compression chambers and a high-pressure port and a low-pressure port in the housing.

In an embodiment the second plane extends perpendicularly to a centerline of the face element, wherein the face element can be mounted in the housing at different rotational positions about its centerline.

In a preferred embodiment the pistons, the cylindrical sleeves, the acute angle, the barrel plate, the face element, the first plane and the second plane are front pistons, front cylindrical sleeves, a front acute angle, a front barrel plate, a front face element, a front first plane and a front second plane, respectively, wherein an opposite side of the flange is provided with a plurality of rear pistons which are fixed to the flange at equiangular distance about the first axis of rotation, and wherein the device also comprises a plurality of rear cylindrical sleeves cooperating with the rear pistons to form respective compression chambers of variable volume, wherein the rear cylindrical sleeves are rotatable about a third axis of rotation which intersects the first axis of rotation by a rear acute angle such that upon rotating the shaft the volume of the compression chambers change, a rear barrel plate being rotatable about the third axis and having a first side for supporting the rear cylindrical sleeves, wherein the first side is directed to the rear pistons, and an opposite second side which is supported by a supporting surface of a plate-shaped rear face element which is fixed to the housing, which supporting surface lies in a rear first plane and the rear face element has a back side which is located opposite to its supporting surface and supported by the housing which back side lies in a rear second plane, wherein the rear first plane is angled with respect to the rear second plane.

In a specific embodiment a line extending perpendicularly to the front second plane intersects the first axis by a geometrical front acute angle and a line extending perpendicularly to the rear second plane intersects the first axis by a geometrical rear acute angle, wherein said lines are mirror symmetrical with respect to the flange, and wherein they lie in a common plane with the second and third axes.

The embodiments including a front and rear face element provide the opportunity to make different combinations between the front acute angle and the rear acute angle.

In a first variant the front face element and the rear face element are such that the front acute angle equals the sum of the geometrical front acute angle and the angle between the front first plane and the front second plane, and the rear acute angle equals the sum of the geometrical rear acute angle and the angle between the rear first plane and the rear second plane. This means that the front acute angle is the same as the rear acute angle.

In a second variant the front acute angle equals the sum of the geometrical front acute angle and the angle between the front first plane and the front second plane, and the rear acute angle equals the difference between the geometrical rear acute angle and the angle between the rear first plane and the rear second plane. This means that the front acute angle is larger than the rear acute angle, resulting in a smaller overall displacement of the hydraulic device than in case of the first variant.

In a third variant the front acute angle equals the difference between the geometrical front acute angle and the angle between the front first plane and the front second plane, and the rear acute angle equals the difference between the geometrical rear acute angle and the angle between the rear first plane and the rear second plane. The third variant has a smaller overall displacement than the second variant.

An aspect of the invention is also related to a method of manufacturing a hydraulic device as described hereinbefore, wherein the face element is made by supplying an intermediate face plate which includes kidney-shaped ports and a front surface and back surface extending substantially parallel to each other, and machining the intermediate face plate such that its front surface becomes said supporting surface and its back surface becomes said back side of the resulting face element, or wherein the face element is made by supplying an intermediate face plate including the supporting surface and back side which are angled with respect to each other, and machining kidney-shaped ports in the intermediate face plate. Both methods may start with uniform face elements which have already been prepared, such that only a limited modification has to be performed for manufacturing a final face plate which corresponds to a certain displacement.

An aspect of the invention also relates to a group of at least two hydraulic devices, wherein each of the hydraulic devices comprises a housing, a shaft which is mounted in the housing and rotatable about a first axis of rotation, wherein the shaft has a flange extending transversely to the first axis, a plurality of pistons which are fixed to the flange at equiangular distance about the first axis of rotation, a plurality of cylindrical sleeves cooperating with the pistons to form respective compression chambers of variable volume, wherein the cylindrical sleeves are rotatable about a second axis of rotation which intersects the first axis of rotation by an acute angle such that upon rotating the shaft the volumes of the compression chambers change, a barrel plate being rotatable about the second axis and having a first side for supporting the cylindrical sleeves, wherein the first side is directed to the pistons, and an opposite second side which is supported by a supporting surface of a face element which is fixed to the housing, wherein the face element has a back side which is located opposite to the supporting surface and supported by s supporting wall of the housing, wherein at least the supporting walls of the housings, the shafts, the pistons and the cylindrical sleeves of the at least two devices are identical, but their face elements are positioned and/or dimensioned differently such that the respective angles between the supporting surface and the first axis of rotation are different.

In a specific embodiment the face elements are also substantially identical, but the face elements of the at least two devices are mounted at different positions with respect to the respective housings. The face elements may be plate-shaped and the supporting surface may lie in a first plane and the back side may lie in a second plane, wherein the first plane is angled with respect to the second plane. Furthermore, the face elements may have different rotational positions about respective axes having a component in the same direction as the respective first axes of rotation of the devices.

BRIEF DESCRIPTION OF THE DRAWINGS

Aspects of the invention will hereafter be elucidated with reference to very schematic drawings showing an embodiment of the invention by way of example.

DETAILED DESCRIPTION

Figure 1:
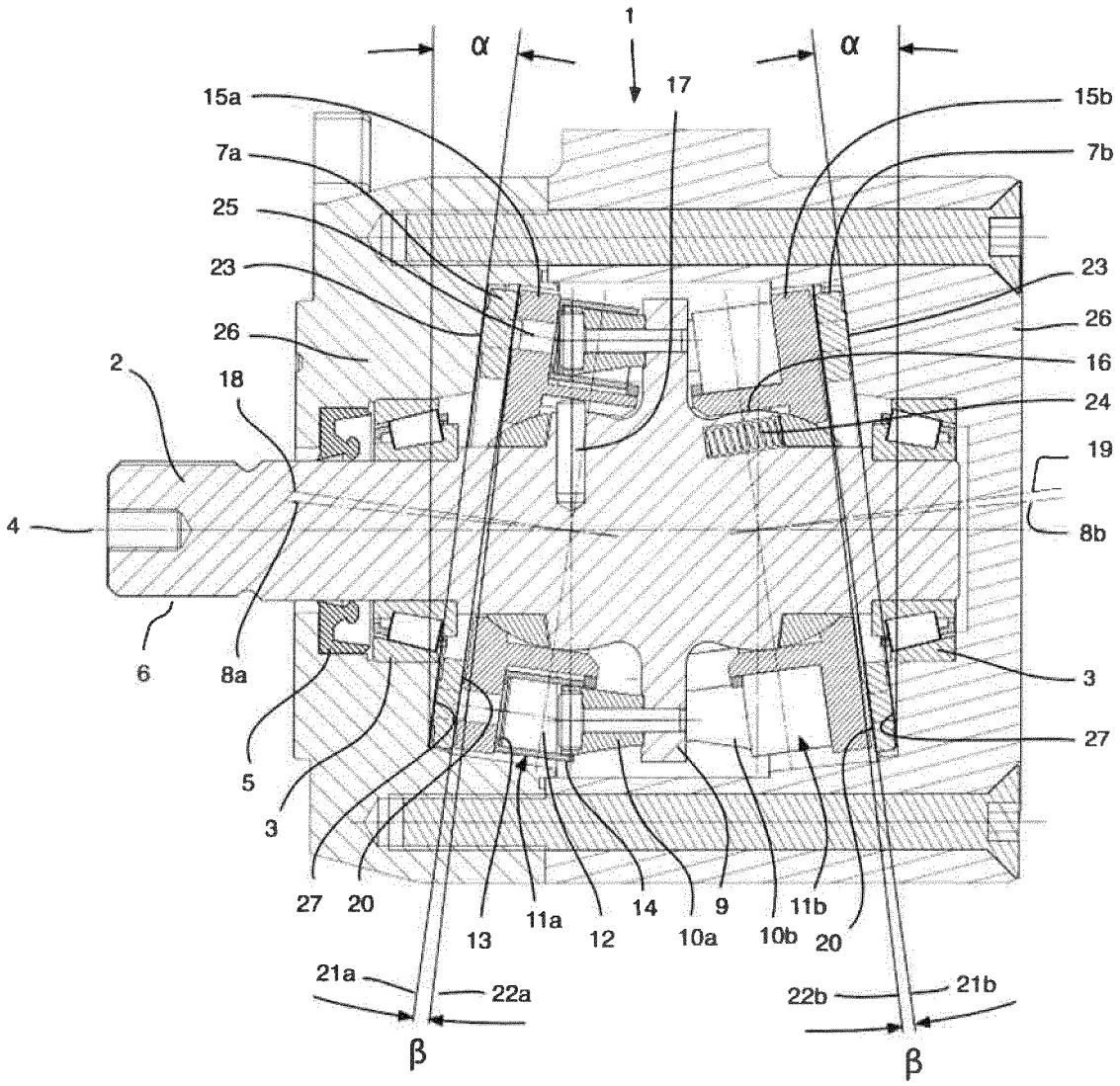
FIG. 1 is a cross-sectional view of an embodiment of a hydraulic device.

FIG. 1 shows internal parts of a hydraulic device 1, such as a pump or hydromotor, which are fitted into a housing 26 in a known manner. The hydraulic device 1 is provided with a shaft 2 which is supported by bearings 3 at both sides of the housing 26 and it is rotatable about a first axis of rotation 4. The housing 26 is provided on the one side with an opening with a shaft seal 5 in a known manner, as a result of which the end of the shaft 2, which is provided with a toothed shaft end 6, protrudes from the housing 26. A motor can be coupled to the toothed shaft end 6 if the hydraulic device 1 is a pump, and a driven tool can be coupled thereto if the hydraulic device 1 is a motor.

The hydraulic device 1 comprises a front face plate 7*a* and a rear face plate 7*b* which are mounted inside the housing 26 at a distance from each other. The front and rear face plates 7*a*, 7*b* have fixed positions with respect to the housing 26 in rotational direction about their centerlines 8*a*, 8*b* and rest against the housing 26. The front and rear face plates 7*a*, 7*b* can be locked with respect to the housing 26 by means of locking pins which fit in the housing 26 and the respective face plates 7*a*, 7*b*, for example. The shaft 2 extends through central through-holes in the front and rear face plates 7*a*, 7*b*.

The shaft 2 is provided with a flange 9 which extends perpendicularly to the first axis of rotation 4. A plurality of front pistons 10*a* are fixed at one side of the flange 9 at equiangular distance about the first axis of rotation 4, in this case fourteen front pistons 10*a*. Similarly, a plurality of rear pistons 10*b* are fixed at an opposite side of the flange 9 at equiangular distance about the first axis of rotation 4, in this case fourteen rear pistons 10*b*. The front and rear pistons 10*a*, 10*b* have centerlines which extend parallel to the first axis of rotation 4. The front and rear face plates 7*a*, 7*b* are angled with respect to each other and with respect to the plane of the flange 9.

Each of the front pistons 10*a* cooperates with a front cylindrical sleeve 11*a* to form a compression chamber 12 of variable volume. Similarly, each of the rear pistons 10*b* cooperates with a rear cylindrical sleeve 11*b* to form a compression chamber of variable volume. The hydraulic device 1 as shown in FIG. 1 has 28 compression chambers 12. Each of the front and rear cylindrical sleeves 11*a*, 11*b* comprises a sleeve bottom 13 and a sleeve jacket 14. Each front and rear piston 10*a*, 10*b* is sealed directly to the inner wall of the sleeve jacket 14 through a ball-shaped piston head.

The sleeve bottoms 13 of the respective front and rear cylindrical sleeves 11*a*, 11*b* are supported by respective front and rear barrel plates 15*a*, 15*b* which are fitted around the shaft 2 by means of respective ball hinges 16 and are coupled to the shaft 2 by means of keys 17. Consequently, the front and rear barrel plates 15*a*, 15*b* rotate together with the shaft 2 under operating conditions. The front barrel plate 15*a* rotates about a second axis 18 and the rear barrel plate 15*b* rotates about a third axis 19. The second axis 18 intersects the first axis 4 and is angled by a front acute angle with respect thereto, whereas the third axis 19 also intersects the first axis 4 and is angled by a rear acute angle with respect thereto. This means that the front and rear cylindrical sleeves 11*a*, 11*b* rotate about the respective second axis 18 and third axis 19, as well. As a consequence, upon rotating the shaft 2 the volumes of the compression chambers 12 change.

During rotation of the front and rear barrel plates 15*a*, 15*b* each of the front and rear cylindrical sleeves 11*a*, 11*b* makes a combined translating and swivelling motion around the cooperating front and rear piston 10*a*, 10*b*. Therefore, the outer side of each piston head is ball-shaped. The ball-shape creates sealing lines between the front and rear pistons 10*a*, 10*b* and the cooperating respective front and rear cylindrical sleeves 11*a*, 11*b*, which sealing line extends perpendicularly to the centerlines of the cooperating front and rear cylindrical sleeves 11*a*, 11*b*. The front and rear pistons 10*a*, 10*b* are conical and their diameters decrease towards the flange 9 in order to allow the relative motion of the cooperating front and rear cylindrical sleeves 11*a*, 11*b* about the respective front and rear pistons 10*a*, 10*b*.

The sides of the respective front and rear barrel plates 15*a*, 15*b* which are directed away from the flange 9 are supported by respective supporting surfaces 20 of the front and rear face plates 7*a*, 7*b*. Due to the inclined orientation of the supporting surfaces 20 with respect to the flange 9 the front and rear barrel plates 15*a*, 15*b* pivot about the ball hinges 16 during rotation with the shaft 2. In the embodiment as shown in FIG. 1 the angles between the first axis of rotation 4 and the centerline 8*a* of the front face plate 7*a* forming a geometrical front acute angle, on the one hand, and between the first axis of rotation 4 and the centerline 8*b* of the rear face plate 7*b* forming a geometrical rear acute angle, on the other hand, are the same, but may be different in an alternative embodiment. Furthermore, the centerlines 8*a*, 8*b* of the front and rear face plates 7*a*, 7*b* are mirror symmetrical with respect to the flange 9 and they lie in a common plane with the second and third axes 18, 19.

The supporting surfaces 20 of the front and rear face plates 7*a*, 7*b* dictate the orientations of the second axis 18 and the third axis 19, respectively. The supporting surface 20 of the front face plate 7*a* lies in a front first plane 21*a* which is angled with respect to a front second plane 22*a* that extends perpendicularly to the centerline 8*a* of the front face plate 7*a*. The front and rear face plates 7*a*, 7*b* have respective back sides 23 which are located opposite to their supporting surfaces 20 and extend perpendicularly to their respective centerlines 8*a*, 8*b*, i.e. the back side 23 of the front face plate 7*a* lies in a plane which extends parallel to the front second plane 22*a*. In FIG. 1 the angle between the plane in which the back side 23 lies and the plane extending perpendicularly to the first axis of rotation 4 is indicated by $\alpha$, whereas the angle between the front second plane 22*a* and the front first plane 21*a* is indicated by $\beta$. In fact the angle $\beta$ represents the inclination of the supporting surface 20 with respect to the back side 23 of the front face plate 7*a*. The angle $\alpha$ corresponds to the geometrical front acute angle and forms an angle between the first axis of rotation 4 and a supporting wall 27 of the housing 26 which supports the front face plate 7*a*.

Similar to the front first plane 21*a* and the front second plane 22*a* at the front face plate 7*a*, a rear first plane 21*b* and a rear second plane 22*b* and angles $\alpha$ and $\beta$ are indicated at the rear face plate 7*b*. The extent of the angles $\alpha$ are the same at the front and rear face plates 7*a*, 7*b* in the embodiment as shown in FIG. 1. The inclinations represented by the angles $\beta$ are also the same, but their directions relative to the respective front and rear first plane 21*a*, 21*b* may vary as a consequence of alternative rotational positions of the front and rear face plates 7*a*, 7*b* about their centerlines 8*a*, 8*b*, respectively.

In the configuration of the hydraulic device 1 as shown in FIG. 1 the front face plate 7*a* has a rotational position about its centerline 8*a* such that the front acute angle between the second axis of rotation 18 and the first axis of rotation 4 is $\alpha+\beta$, i.e. the effective angle between the second axis of rotation 18 and the first axis of rotation 4 is larger than the geometrical front acute angle $\alpha$ between the centerline 8*a* of the front face plate 7*a* and the first axis of rotation 4. This means that the displacement of the front pistons 10*a* within the front cylindrical sleeves 11*a* is relatively large. The orientation of the supporting surface 20 of the rear face plate 7*b* is mirror symmetrical to the supporting surface 20 of the front face plate 7*a* with respect to the flange 9 such that the overall displacement of the hydraulic device 1 in this configuration is relatively large.

If the configuration as shown in FIG. 1 is changed into a configuration where both the front and rear face plates 7*a*, 7*b* are turned 180° about their centerlines 8*a*, 8*b*, the angle between the second axis of rotation 18 and the first axis of rotation 4 will be $\alpha-\beta$, whereas the similar effect will be seen at the rear face plate 7*b*. This means that the overall displacement of the hydraulic device 1 is relatively small. This configuration is illustrated in FIG. 2, where $\alpha=7°$ and $\beta=1°$, such that the front acute angle between the second axis 18 and the first axis of rotation 4 is 6° and the rear acute angle between the third axis 19 and the first axis of rotation 4 is also 6°.

Figure 3:
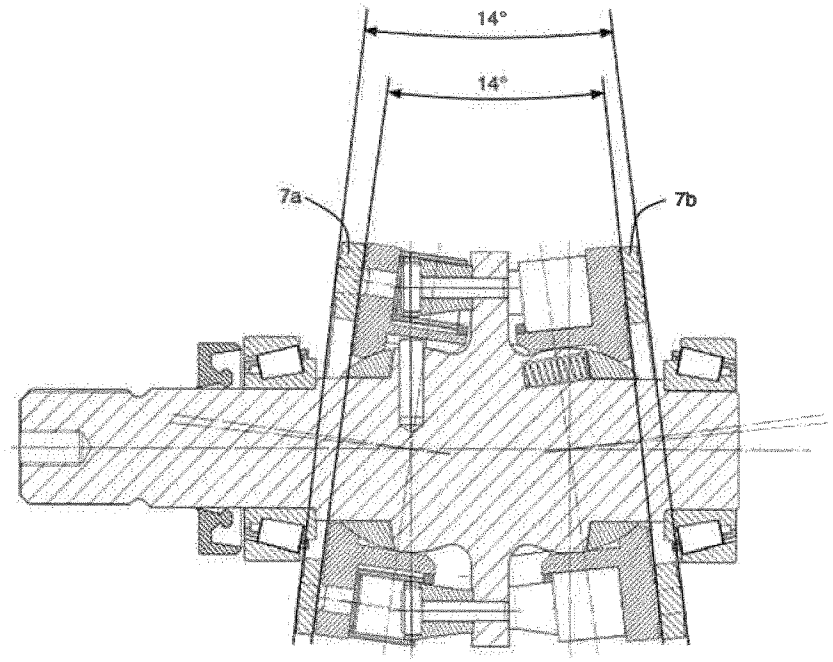
FIG. 2-4 are similar views as FIG. 1, but showing hydraulic devices having different displacements.

FIG. 3 shows another configuration in which also $\alpha=7°$ and $\beta=1°$, but the front face plate 7*a* is mounted such that $\alpha+\beta=8°$ whereas the rear face plate 7*b* is mounted such that $\alpha-\beta=6°$. On average, the virtual angles between the second axis 18 and the first axis 4, on the one hand, and the third axis 19 and the first axis 4, on the other hand, are 7°. In this case the hydraulic device 1 is similar to an embodiment which has face plates including parallel supporting surfaces and back sides, respectively, whereas $\alpha=7°$ and $\beta=0$.

Figure 4:
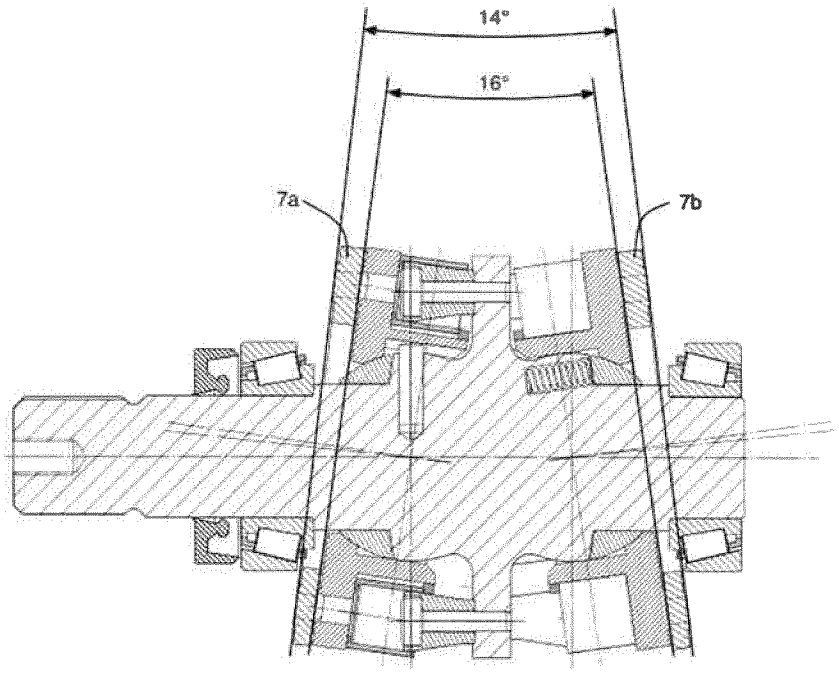

FIG. 4 shows the same configuration as FIG. 1 in which $\alpha=7°$ and $\beta=1°$, but the front face plate 7*a* is mounted such that $\alpha+\beta=8°$ and the rear face plate 7*b* is mounted such that $\alpha+\beta=8°$. Hence, both the front and rear acute angle are 8°.

Figure 2:
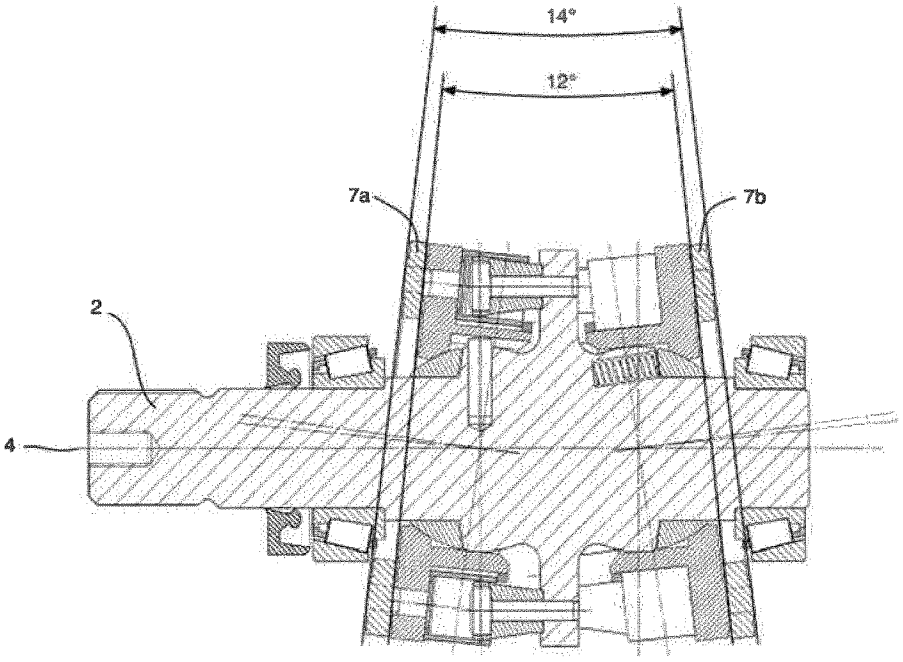

The configurations as shown in FIGS. 2, 3 and 4 have increasing displacements, although the mutual orientations of the back sides 23 of the respective front and rear face plates 7*a*, 7*b* are the same: in this case the angle between the back sides is $2\alpha=14°$. This means that in series production the same components can be used for assembling hydraulic devices of different displacements. If desired, the locations of kidney-shaped fluid ports through the first and rear face plates 7*a*, 7*b* may be different for different displacements. In practice, the housing 26 and the front and rear face plates 7*a*, 7*b* may be adapted such that each face plate can be mounted in the housing 26 at two different rotational positions about its centerline 8*a*, 8*b*.

The front and rear barrel plates 15*a*, 15*b* are pressed against the respective front and rear face plates 7*a*, 7*b* by means of springs 24 which are mounted in holes in the shaft 2. The compression chambers 12 communicate via a central through-hole in the respective sleeve bottoms 13 with cooperating passages 25 in the front and rear barrel plates 15*a*, 15*b*. The passages 25 in the front and rear barrel plates 15*a*, 15*b* communicate via kidney-shaped ports in the front and rear face plates 7*a*, 7*b* with a high-pressure port and a low-pressure port in the housing 26 (not shown).

It is not necessary that the front and rear face plate 7*a*, 7*b* can be mounted at different rotational positions about their centerlines 8*a*, 8*b*. More specifically, it is possible to manufacture face plates for assembling similar devices 1 with different acute angles, wherein each face plate fits in the housing in only a single position. This means that before assembling, the face plates must be provided with different angles between the supporting surface and the back side. For example, one may start with a uniform intermediate face plate which already includes kidney-shaped ports and a front surface and back surface extending substantially parallel to each other. Subsequently, the uniform intermediate face plate is machined such that its front surface becomes the supporting surface 20 and its back surface becomes the back side 23 of the resulting face element 7*a*, 7*b*. The angle between the supporting surface 20 and the back side 23 may be +1° and −1°, for example, but deviating angles are conceivable. Alternatively, one may start with a uniform intermediate face plate which is already provided with the supporting surface 20 and back side 23 that are angled with respect to each other. In this case, the uniform intermediate face plates may all have the same angle, for example 1°, whereas different displacements of the device can be achieved by positioning them in the respective housings differently. Before assembling the device 1, kidney-shaped ports can be machined in the intermediate face plate, depending on the intended position and orientation of the face plate in the housing. In both manners of manufacturing, the prepared uniform intermediate face plates minimizes the number of different manufacturing steps before assembly of hydraulic devices having different displacements.

The invention is not limited to the embodiment shown in the drawings and described hereinbefore, which may be varied in different manners within the scope of the claims and their technical equivalents. For example, it is also conceivable to combine a front face plate having an angle $\beta$ which is nonzero and a rear face plate having an angle $\beta$ which is zero or the other way around. Furthermore, the face plate may have a supporting surface which extends perpendicularly to its centerline, whereas its back side is inclined with respect to a plane extending perpendicularly to its centerline.

The invention claimed is:

1. A hydraulic device comprising a housing, a shaft which is mounted in the housing and rotatable about a first axis of rotation, wherein the shaft has a flange extending transversely to the first axis, a plurality of pistons which are fixed to the flange at equiangular distance about the first axis of rotation, a plurality of cylindrical sleeves cooperating with the pistons to form respective compression chambers of variable volume, wherein the cylindrical sleeves are rotatable about a second axis of rotation which intersects the first axis of rotation by an acute angle ($\alpha\pm\beta$) such that upon rotating the shaft the volumes of the compression chambers change, a barrel plate being rotatable about the second axis and having a first side for supporting the cylindrical sleeves, wherein the first side is directed to the pistons, and an opposite second side which is supported by a supporting surface of a plate-shaped face element that is separate from the housing and which is fixed to the housing such that the face element has a fixed position with respect to the housing in a rotational direction about a centerline thereof and rests against a supporting wall of the housing, which supporting wall extends non-perpendicularly with respect to the first axis of rotation such that a largest part of the acute angle is created by the orientation of the supporting wall of the housing, wherein the supporting surface lies in a first plane and the face element has a back side which is located opposite to the supporting surface and supported by the housing, which back side lies in a second plane, wherein the first plane is angled with respect to the second plane, wherein an angle between the first plane and the second plane is smaller than said acute angle.

2. The hydraulic device according to claim 1, wherein the angle between the first plane and the second plane is smaller than 1.5°.

3. The hydraulic device according to claim 2, wherein the housing and the face element are configured such that the face element is mountable in the housing at at least two different mutual positions in which said acute angle ($\alpha\pm\beta$) is different.

4. The hydraulic device according to claim 1, wherein the housing and the face element are configured such that the face element is mountable in the housing at at least two different mutual positions in which said acute angle ($\alpha\pm\beta$) is different.

5. The hydraulic device according to claim 4, wherein the face element is configured to be mounted in the housing at different rotational positions about an axis having a component in the same direction as the first axis of rotation.

6. The hydraulic device according to claim 5, wherein the second plane extends perpendicularly to a centerline of the face element, wherein the face element is configured to be mounted in the housing at different rotational positions about its centerline.

7. The hydraulic device according to claim 5, wherein the pistons, the cylindrical sleeves, the acute angle, the barrel plate, the face element, the first plane, the second plane and the angle between the first plane and the second plane are front pistons, front cylindrical sleeves, a front acute angle ($\alpha\pm\beta$), a front barrel plate, a front face element, a front first plane, a front second plane and a front angle, respectively, wherein an opposite side of the flange is provided with a plurality of rear pistons which are fixed to the flange at equiangular distance about the first axis of rotation, and wherein the hydraulic device also comprises a plurality of rear cylindrical sleeves cooperating with the rear pistons to form respective compression chambers of variable volume, wherein the rear cylindrical sleeves are rotatable about a third axis of rotation which intersects the first axis of rotation by a rear acute angle ($\alpha\pm\beta$) such that upon rotating the shaft the volumes of the compression chambers change, a rear barrel plate being rotatable about the third axis and having a first side for supporting the rear cylindrical sleeves, wherein the first side is directed to the rear pistons, and an opposite second side which is supported by a supporting surface of a plate-shaped rear face element that is separate from the housing and which is fixed to the housing such that the rear face element has a fixed position with respect to the housing in a rotational direction about a centerline thereof and rests against a rear supporting wall of the housing, which rear supporting wall extends non-perpendicularly with respect to the first axis of rotation such that a largest part of the rear acute angle is created by the orientation of the rear supporting wall of the housing, which supporting surface lies in a rear first plane and the rear face element has a back side which is located opposite to its supporting surface and supported by the housing which back side lies in a rear second plane, wherein the rear first plane is angled with respect to the rear second plane, and wherein a rear angle between the rear first plane and the rear second plane is smaller than said rear acute angle.

8. The hydraulic device according to claim 7, wherein a first line extending perpendicularly to the front second plane intersects the first axis by a geometrical front acute angle ($\alpha$) and a second line extending perpendicularly to the rear second plane intersects the first axis by a geometrical rear acute angle ($\alpha$), wherein said first and second lines are mirror symmetrical with respect to the flange, and wherein said first and second lines lie in a common plane with the second and third axes.

9. The hydraulic device according to claim 8, wherein the front acute angle equals a sum of the geometrical front acute angle ($\alpha$) and the front angle ($\beta$) between the front first plane and the front second plane, and the rear acute angle equals a sum of the geometrical rear acute angle ($\alpha$) and the rear angle ($\beta$) between the rear first plane and the rear second plane.

10. The hydraulic device according to claim 8, wherein the front acute angle equals a sum of the geometrical front acute angle ($\alpha$) and the front angle ($\beta$) between the front first plane and the front second plane, and the rear acute angle equals a difference between the geometrical rear acute angle ($\alpha$) and the rear angle ($\beta$) between the rear first plane and the rear second plane.

11. The hydraulic device according to claim 8, wherein the front acute angle equals a difference between the geometrical front acute angle ($\alpha$) and the front angle ($\beta$) between the front first plane and the front second plane, and the rear acute angle equals a difference between the geometrical rear acute angle ($\alpha$) and the rear angle ((3) between the rear first plane and the rear second plane.

12. The hydraulic device according to claim 1, wherein the angle between the first plane and the second plane is smaller than 1.2°.

13. A method of manufacturing a hydraulic device comprising a housing, a shaft which is mounted in the housing and rotatable about a first axis of rotation, wherein the shaft has a flange extending transversely to the first axis, a plurality of pistons which are fixed to the flange at equiangular distance about the first axis of rotation, a plurality of cylindrical sleeves cooperating with the pistons to form respective compression chambers of variable volume, wherein the cylindrical sleeves are rotatable about a second axis of rotation which intersects the first axis of rotation by an acute angle such that upon rotating the shaft the volumes of the compression chambers change, a barrel plate being rotatable about the second axis and having a first side for supporting the cylindrical sleeves, wherein the first side is directed to the pistons, and an opposite second side which is supported by a supporting surface of a plate-shaped face element that is separate from the housing and which is fixed to the housing such that the face element has a fixed position with respect to the housing in a rotational direction about a centerline thereof and rests against a supporting wall of the housing, which supporting wall extends non-perpendicularly with respect to the first axis of rotation such that a largest part of the acute angle is created by the orientation of the supporting wall of the housing, wherein the supporting surface lies in a first plane and the face element has a back side which is located opposite to the supporting surface and supported by the housing, which back side lies in a second plane, wherein the first plane is angled with respect to the second plane, wherein an angle between the first plane and the second plane is smaller than said acute angle, wherein the face element is made by supplying an intermediate face plate which includes kidney-shaped ports and a front surface and back surface extending substantially parallel to each other, and machining the intermediate face plate such that its front surface becomes said supporting surface and its back surface becomes said back side of the resulting face element.

14. A group of at least two hydraulic devices, wherein each of the hydraulic devices comprises a housing, a shaft which is mounted in the housing and rotatable about a first axis of rotation, wherein the shaft has a flange extending transversely to the first axis, a plurality of pistons which are fixed to the flange at equiangular distance about the first axis of rotation, a plurality of cylindrical sleeves cooperating with the pistons to form respective compression chambers of variable volume, wherein the cylindrical sleeves are rotatable about a second axis of rotation which intersects the first axis of rotation by an acute angle ($\alpha\pm\beta$) such that upon rotating the shaft the volumes of the compression chambers change, a barrel plate being rotatable about the second axis and having a first side for supporting the cylindrical sleeves, wherein the first side is directed to the pistons, and an opposite second side which is supported by a supporting surface of a face element that is separate from the housing and which is fixed to the housing such that the face element has a fixed position with respect to the housing in a rotational direction about a centerline thereof and rests against a supporting wall of the housing, which supporting wall extends non-perpendicularly with respect to the first axis of rotation such that a largest part of the acute angle is created by the orientation of the supporting wall of the housing, wherein the face element has a back side which is located opposite to the supporting surface and supported by a supporting wall of the housing, wherein at least the supporting walls of the housings, the shafts, the pistons and the cylindrical sleeves of the at least two hydraulic devices are identical, but the respective face elements of each of the hydraulic devices are positioned and/or dimensioned differently such that an angle between the supporting surface and the first axis of rotation of each of the hydraulic devices is different.

15. The group of at least two hydraulic devices according to claim 14, wherein the face elements are also substantially identical, but the face elements of the at least two hydraulic devices are mounted at different positions with respect to the respective housings.

16. The group of at least two hydraulic devices according to claim 15, wherein the face elements have different rotational positions about respective axes having a component in the same direction as the respective first axes of rotation of the hydraulic devices.

17. The group of at least two hydraulic devices according to claim 15, wherein the face elements are plate-shaped and the supporting surface lies in a first plane and the back side lies in a second plane, wherein the first plane is angled with respect to the second plane.

18. The group of at least two hydraulic devices according to claim 14, wherein the face elements are plate-shaped and the supporting surface lies in a first plane and the back side lies in a second plane, wherein the first plane is angled with respect to the second plane.

19. The group of at least two hydraulic devices according to claim 18, wherein the face elements have different rotational positions about respective axes having a component in the same direction as the respective first axes of rotation of the hydraulic devices.

20. A method of manufacturing a hydraulic device comprising a housing, a shaft which is mounted in the housing and rotatable about a first axis of rotation, wherein the shaft has a flange extending transversely to the first axis, a plurality of pistons which are fixed to the flange at equiangular distance about the first axis of rotation, a plurality of cylindrical sleeves cooperating with the pistons to form respective compression chambers of variable volume, wherein the cylindrical sleeves are rotatable about a second axis of rotation which intersects the first axis of rotation by an acute angle such that upon rotating the shaft the volumes of the compression chambers change, a barrel plate being rotatable about the second axis and having a first side for supporting the cylindrical sleeves, wherein the first side is directed to the pistons, and an opposite second side which is supported by a supporting surface of a plate-shaped face element that is separate from the housing and which is fixed to the housing such that the face element has a fixed position with respect to the housing in a rotational direction about a centerline thereof and rests against a supporting wall of the housing, which supporting wall extends non-perpendicularly with respect to the first axis of rotation such that a largest part of the acute angle is created by the orientation of the supporting wall of the housing, wherein the supporting surface lies in a first plane and the face element has a back side which is located opposite to the supporting surface and supported by the housing, which back side lies in a second plane, wherein the first plane is angled with respect to the second plane, wherein an angle between the first plane and the second plane is smaller than said acute angle, wherein the face element is made by supplying an intermediate face plate including the supporting surface and back side which are angled with respect to each other, and machining kidney-shaped ports in the intermediate face plate.

* * * * *